United States Patent [19]

Price et al.

[11] Patent Number: 5,025,521

[45] Date of Patent: Jun. 25, 1991

[54] SHOE LASTING MACHINE

[76] Inventors: Frank C. Price, 15 Southland Road, Leicester LE2 3RJ, England; Gerhard Giebel, Hubertusstrasse 12, 6232 Bad Soden 2, Fed. Rep. of Germany

[21] Appl. No.: 339,974

[22] Filed: Apr. 18, 1989

[30] Foreign Application Priority Data

Apr. 22, 1988 [GB] United Kingdom ..... 8809499

[51] Int. Cl.[5] ..... A43D 23/02

[52] U.S. Cl. ..... 12/12.4; 12/12

[58] Field of Search ..... 12/12, 12.4, 10, 12.2, 12/10.5

[56] References Cited

U.S. PATENT DOCUMENTS

| | | | |
|---|---|---|---|
| 3,196,470 | 7/1965 | Bowler | 12/12.4 |
| 3,258,799 | 7/1966 | Weinschenk | 12/12 |
| 3,345,659 | 10/1967 | Weinschenk | 12/12 |
| 3,434,169 | 3/1969 | Teerling et al. | 12/12 |
| 4,517,697 | 5/1985 | Vornberger | 12/12 |
| 4,530,124 | 7/1985 | Sommer | 12/12.4 |
| 4,777,685 | 10/1988 | Giebel et al. | 12/12.4 |

FOREIGN PATENT DOCUMENTS

| | | | |
|---|---|---|---|
| 2021376 | 5/1973 | Fed. Rep. of Germany | 12/12 |
| 2105572 | 3/1983 | United Kingdom | 12/12.2 |

*Primary Examiner*—Steven N. Meyers

[57] ABSTRACT

A wiper assembly (120, 220) for a pulling over and toe lasting machine provides for variation of the configuration of the continuous wiping surface (146, 246) and of the leading edge (144, 244) of the wiper assembly. This is achieved by each wiper plate arrangement comprising two wiper plates (132, 152; 232, 252) pivotally connected to one another whereby their angular relationship can be varied. In one embodiment the wiper plate configuration is varied while the machine is in the rest position, and the wiper plates are then clamped in such position; in another embodiment the individual wiper plates (232, 252) are driven independently of one another whereby the configuration can be varied not only at the start of the lasting operation but during the course of the lasting operation; furthermore, by this independent means, the configuration can be varied differently for left and right shoes. Such variation of configuration in its more complicated aspects is achieved by the use of electronic control means, but in the simpler version the variation may be effected manually. In order to avoid risk of collision between the wiper assembly and an adhesive applicator device (11), furthermore, the latter also has a facility for variation of its configuration.

37 Claims, 6 Drawing Sheets

SHOE LASTING MACHINE

BACKGROUND OF THE INVENTION

This invention is concerned with shoe lasting machines and more especially those with a wiper assembly for a shoe lasting machine, comprising two wiper plate arrangements providing a continuous wiping surface and leading edge and being mounted for pivotal movement relative to one another about a centrally disposed pivot.

Wiper assemblies of such a construction are generally well known: see e.g. UK patent specification No. 1239326 and European patent specification No. 0210824.

In such assemblies, the shape of the continuous wiping surface, as viewed in plan, and the leading edge thereof is fixed, since conventionally each wiper plate arrangement comprises a single wiper plate machined from a single piece of metal. Especially in the case of the lasting of toe ends of shoes, however, it will be appreciated that there are distinct differences in shape, often dictated by fashion, but nevertheless with variations within each fashion style, and with a fixed shape of wiper plates it is thus necessary to provide different sets of wiper plates to suit the particular style of shoe to be operated upon. In particular, it will be borne in mind that toe shapes fall into three general categories: pointed, rounded and square. Within any such category it may sometimes be possible to compromise between similar styles to achieve a satisfactory lasting result, but it would rarely be possible to compromise between two categories. Consequently, it is customary to provide suitable sets of wiper plates appropriate to any given style of shoe. Not only does this lead to increased expense in the provision of such "bespoke" components, and not only is the fitting of such components time-consuming, leading to loss in productivity, but also where may well be problems of supply, especially where the user of the machine is located a long distance away from the supplier.

OBJECTS OF THE INVENTION

It is thus one of the objects of the present invention to provide an improved wiper assembly for a shoe lasting machine, wherein the configuration of the wiper plate arrangements is variable according to the style and size of shoe to be operated upon.

It is another object of the present invention to provide an improved pulling over and toe lasting machine which can accommodate to various styles and sizes of shoe without the need to fit "bespoke" components for that purpose.

SUMMARY OF THE INVENTION

The invention thus provides, in one of its several aspects, a wiper assembly for a shoe lasting machine that includes two wiper plate arrangements which provide continuous wiper surfaces and a leading edge and which are mounted for pivotal movement relative to one another about a centrally disposed pivot. The wiper plate arrangement includes a first toe wiper plate that is mounted for pivotal movement about the centrally disposed pivot and a second, forepart wiper plate which is mounted for pivotal adjusting movement about a second pivot in relation to the toe wiper plate thus to vary the configuration of the continuous wiping surface and the leading edge that is formed by the two wiper plates.

A mechanism is provided so that the forepart wiper plate is maintained in adjusted position in relation to the toe wiper plate so that when the wiper assembly is in use during in wiping movement of the wiper plate arrangements, lasting marginal portions of the upper of a shoe will be wiped over and pressed against corresponding marginal portions of the insole of the shoe.

By thus providing for pivotal movement between the various components of each wiper plate arrangement and also between the two wiper plate arrangements and by maintaining them in the adjusted position, it will be appreciated, the configuration of the leading edge of the wiper assembly can be set according to the style and size of shoe to be operated on without losing the continuous wiping surface.

Conveniently each wiper plate arrangement is supported by a base plate and comprises a wiper carrier by which the pivotal movement and also linear movement relative to the base plate is transmitted to the toe wiper plate and to the forepart plate maintained in adjusted position in relation thereto as aforesaid. Moreover, in such an arrangement, preferably the toe wiper plate is mounted for pivotal adjusting movement relative to the wiper carrier about the centrally disposed pivot, means being provided for locking the toe wiper plate in an adjusted position. In this way, it will be appreciated, the configuration of the wiper surface and the leading edge of each wiper plate arrangement can be further adjusted according to the style and size of a shoe which is to be operated upon. Conveniently, furthermore, in the described arrangement, the forepart wiper plate is pivotally connected to the toe wiper plate so that adjustment of the position of the latter also adjusts the position of the former in relation to the carrier, and further the position of the forepart wiper plate relative to the toe wiper plate and to the carrier is independently adjustable.

Moreover, while the wiper carrier is so provided means may be disposed thereon for adjusting the position of the forepart wiper plate in relation thereto in which position the wiper plate is maintained as aforesaid during the inwiping movement of the wiping plate arrangement. Preferably, furthermore, a means is provided for locking the forepart wiper plate in an adjusted position on the wiper carrier although in certain circumstances, this may not be necessary since the wiper plate will always assume its adjusted position as inwiping movement takes place and the wiper is brought into engagement with the shoe and will be maintained in that position as it traverses the edge of the shoe to wipe lasting marginal portions of the shoe upper over and press them against corresponding marginal portions of the insole.

In the wiper assembly in accordance with the invention referred to above, preferably the two wiper plate arrangements are mounted for movement relative to a shoe supported by a shoe support not only pivotally relative to one another as aforesaid, but also bodily in a direction extending lengthwise of the shoe bottom. In such an arrangement, further, drive means are preferably provided for a effecting such movement of the wiper plate arrangements. Furthermore, conveniently, the wiper plate arrangements are mounted in a support by which a cam track arrangement is supported, the arrangement being such that as lengthwise bodily movement of the wiper plate arrangements is effected as aforesaid, the cam track arrangement is effective to cause pivoting inwiping movement to take place. In this way, a single motor can be used the various motions of the wiper plate arrangements which can be effected simultaneously.

As is conventional in wiper assemblies for shoe lasting machines, the centrally disposed pivot preferably comprises a "button" having a surface forming part of the continuous wiping surface, and furthermore in the wiper assembly in accordance with the invention, each second pivot is similarly constituted, thereby enabling the continuous wiping surface to be achieved.

The buttons providing the centrally disposed pivot and each second pivot may, furthermore, either be formed separately from the wiper plates themselves, or may be formed integral with one of the wiper plates, in which latter case the adjacent wiper plate which is pivotally connected in this manner is provided with a complementarily shaped portion for cooperating with such button.

For effecting such adjusting movement of the wiper plates in, said one embodiment the toe wiper plate adjusting means may be manually operable , e.g. by suitable pin-and-slot connections and a simple clamping arrangement, or indeed by threadedly engaging adjustment screws, or may be motorised. In particular, in the case of an electronically controlled machine such motorisation may be by a suitable n.c. motor operating in accordance with shoe pattern data stored in an electronic memory. Alternatively, motorisation of the adjustment may be nevertheless under operator control, if desired.

By the phrase "n.c. motor" where used herein is to be understood a motor the operation of which is controlled by control or drive signals supplied thereto in accordance with stored information appropriate to a desired operation, such information usually being stored in the form of digitized coordinate axis values. Examples of such motor are stepping motors and d.c. servomotors.

Because of the relatively limited space available for motorisation, it is preferable that any suitable drive means is spaced from the actual path of inward and linear movement of the wiper plate arrangements. With such an arrangement, therefore, adjustment means is preferably arranged to be operatively connected with the toe wiper plate when the wiper plate arrangements are in a rest position, and prior to lengthwise movement of said arrangements being effected as aforesaid, whereby such operative connection is disconnected, the first clamping means is rendered operative. In addition, if desired, the setting means for the forepart wiper plates may be similarly arranged to be operatively connected with the plate only when the wiper plates are in such rest position.

The invention also provides, in another of its several aspects, a wiper assembly for a shoe lasting machine comprising two wiper plate arrangements each providing a continuous wiper surface and leading edge and being mounted for movement relative to a shoe supported by a shoe support, both pivotally relative to one another about a central disposed pivot and also bodily in a direction extending lengthwise of the shoe bottom thus to effect an inwiping movement whereby lasting of marginal portions of the upper of the shoes are wiped over and pressed against corresponding marginal portions of the insole. Each wiper plate arrangement comprises a wiper carrier which is mounted for pivotal movement about the centrally disposed pivot and is movable linearly and bodily with the wiper carrier of the other wiper plate arrangement, together with the centrally disposed pivot. A first toe wiper plate is fixedly mounted on the wiper carrier for pivotal movement therewith about the centrally disposed pivot and a second forepart wiper plate which is mounted on the wiper carrier for pivotal movement about a second pivot disposed between the first and the second wiper plates relative to the wiper carrier and also to the first wiper plate while maintaining the continuous wiping surface and leading edge, together with a first drive means for effecting pivotal movement of the wiper carrier and thus the first and second wiper plates mounted as aforesaid thereon and a second drive means, operable independently of the first drive means for effecting pivotal movement of the second wiper plate relative thereto and to the first wiper plate.

In the case of this further embodiment, instead of utilising conventional drive means, including a conventional cam track arrangement (as in the case of the first embodiment referred to above), first and second plate drive means are associated respectively with the wiper carrier and the forepart wiper plates for effecting arcuate movement thereof in timed relationship with the operation of the drive means for the carriage. In this way as already mentioned, it is thus longer a question merely of setting the various component parts of each wiper plate arrangement to a particular profile or configuration and clamping them in that configuration for the lasting operation, but rather the path of movement of the toe and forepart wiper plates can be independently controlled during the lasting operation. Furthermore, preferably the first and second plate drive means each comprise two motors, one associated with each of the wiper plates, said motors being driven independently of one another. By this arrangement, it will be appreciated, the wiper plates in one arrangement need not be driven symmetrically with the wiper plates in the other wiper plate arrangement, so that the wiper plates can be driven according to whether the shoe is a left or a right and according to the asymmetrical contour of the shoe bottom.

From this it will be appreciated that the present invention is particularly suitable, especially in its second embodiment, for use in a machine having electronic control means wherein the various drive means each comprise an n.c. motor (as hereinbefore defined), operating in response to control signals generated in accordance with shoe pattern data stored in an electronic memory.

It will be further appreciated that it would be advantageous in a shoe lasting machine provided with a wiper assembly having a variable configuration as above described, to provide also an adhesive applicator device which is itself of variable configuration, since, quite apart from any risk of collision taking place if the adhesive applicator device and wiper assembly do not "match", the exchange of applicator devices is tedious and time-consuming but necessary, since the use of compromise shapes is unsatisfactory.

BRIEF DESCRIPTION OF THE DRAWINGS

There now follows a detailed description, to be read with reference to the accompanying drawings, of a pulling over and toe lasting machine in accordance with the invention, said machine incorporating an adhesive applicator device and two embodiments of wiper assembly, illustrative of the invention in its adhesive applicator device and wiper assembly aspects respectively.

(The adhesive applicator device is itself the subject of a separate application filed on even date with the present application.) It will of course be appreciated that this machine and the component parts thereof have been selected for description merely by way of exemplification of the invention and not by way of limitation thereof.

In the accompanying drawings

Figure 1:
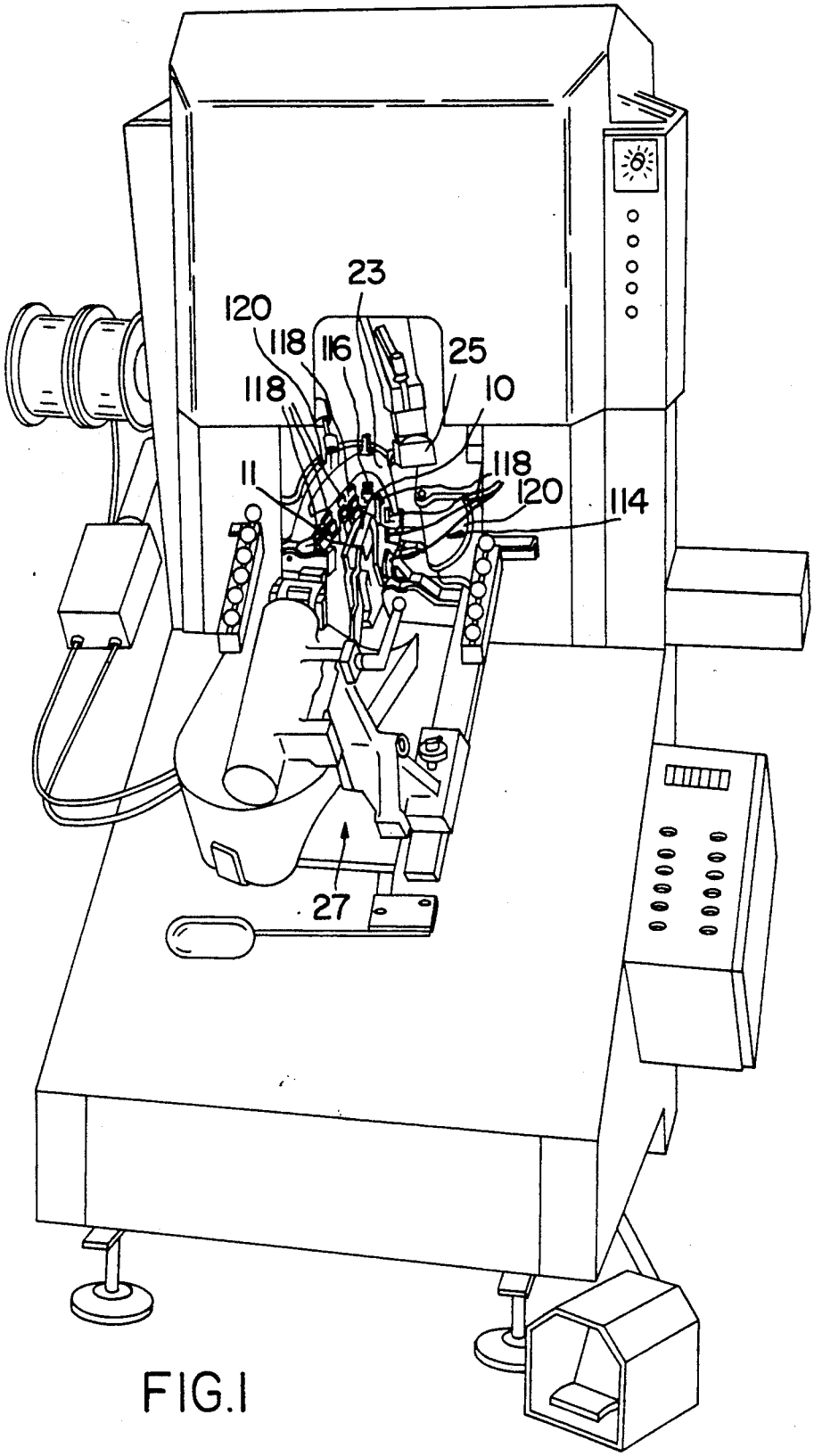
Figure 2:
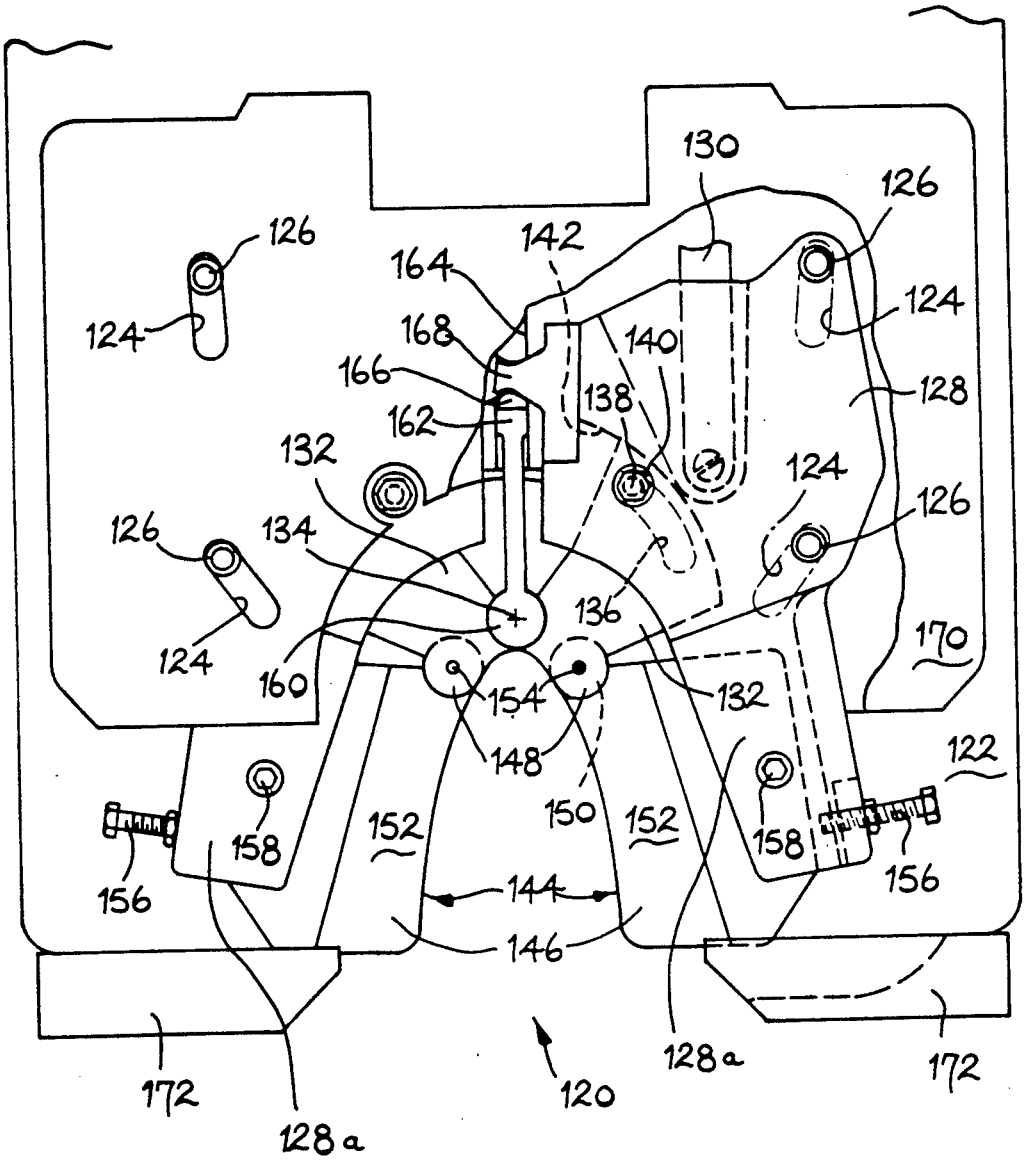
Figure 3:
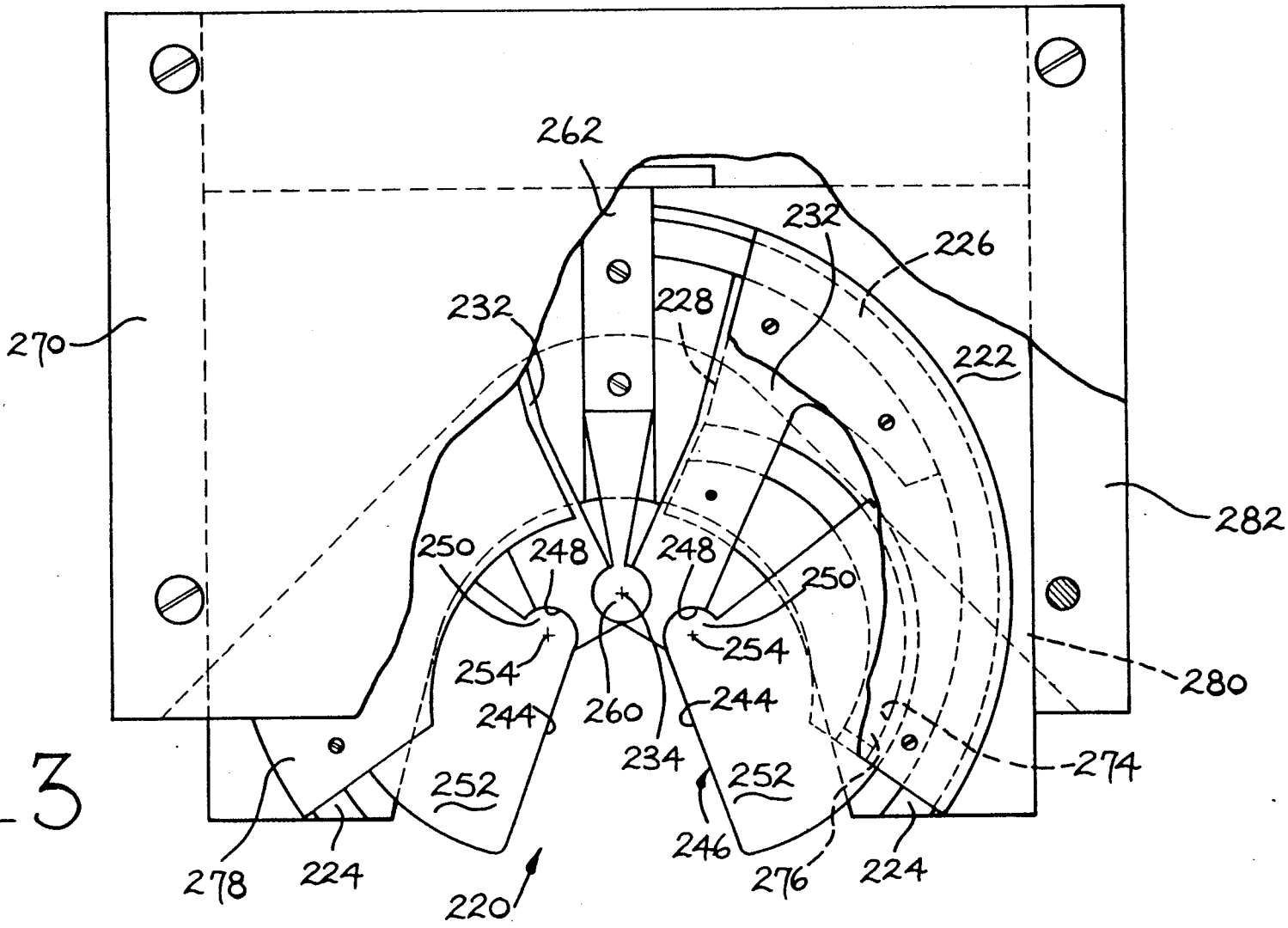
Figure 4:
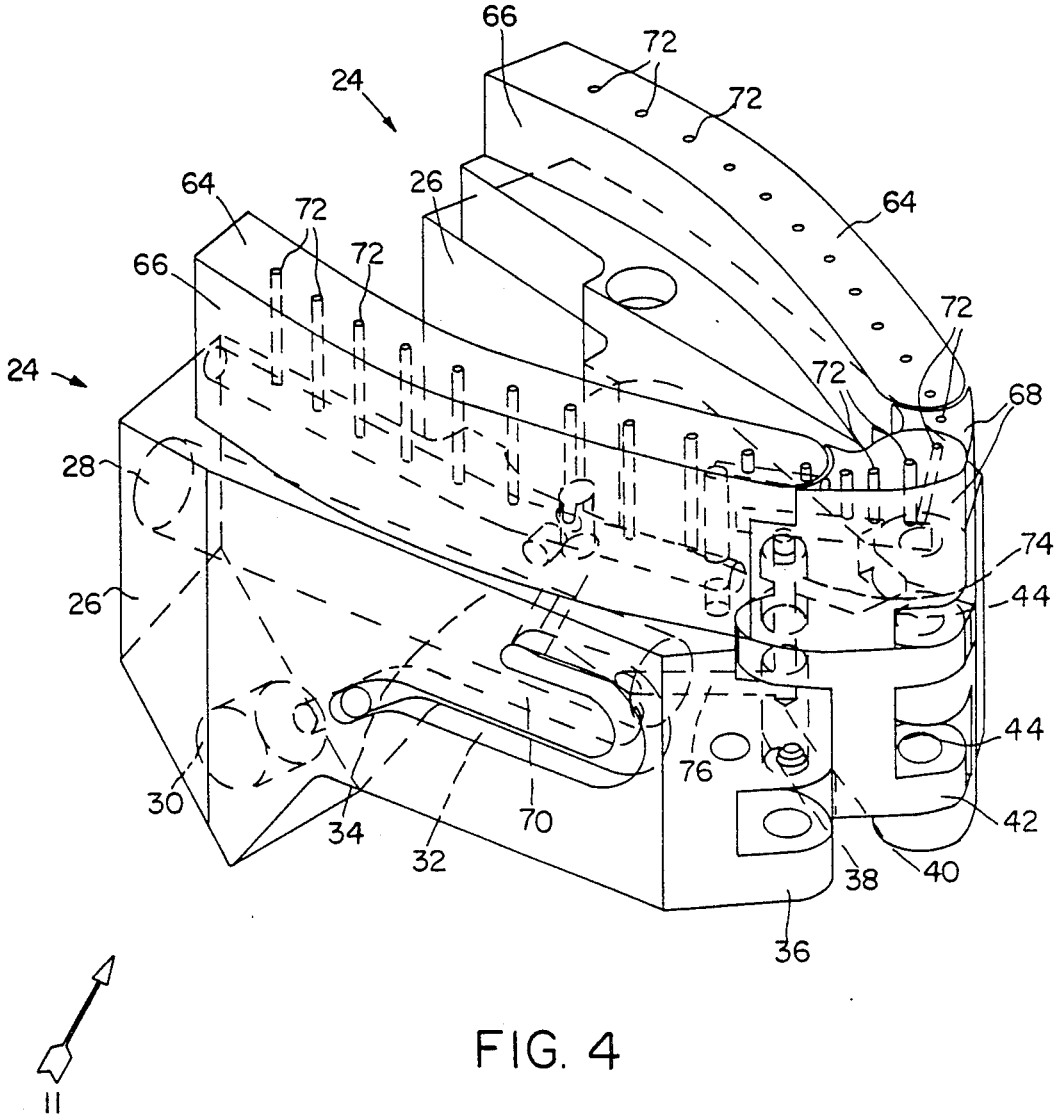
Figure 5:
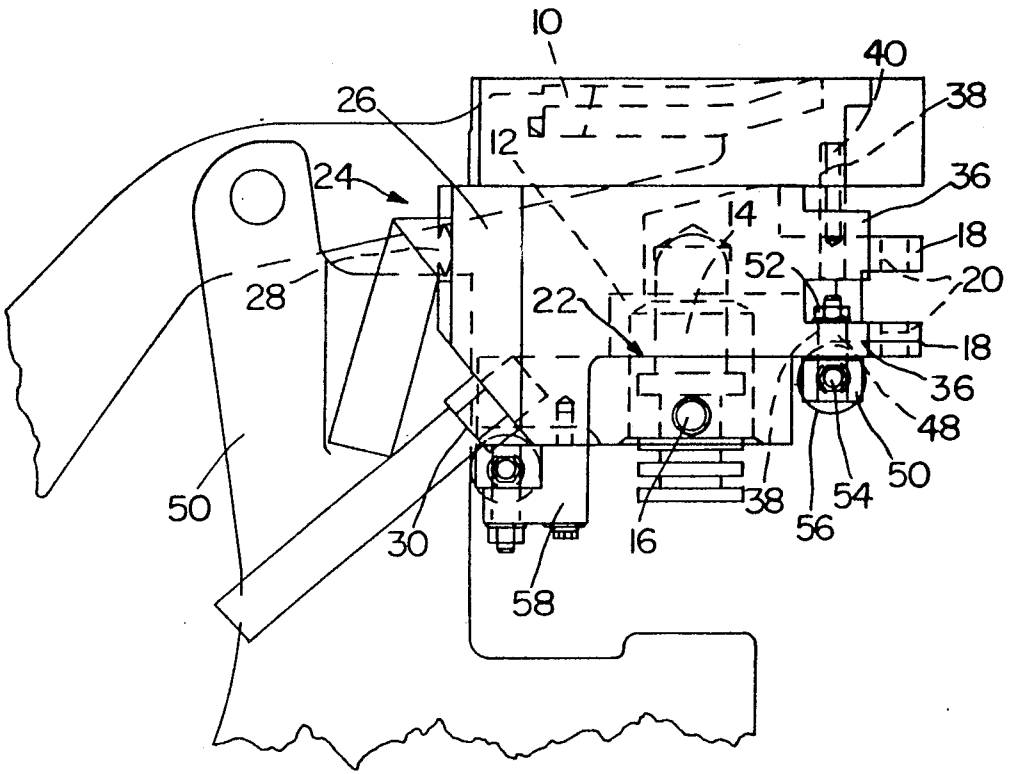
Figure 6:
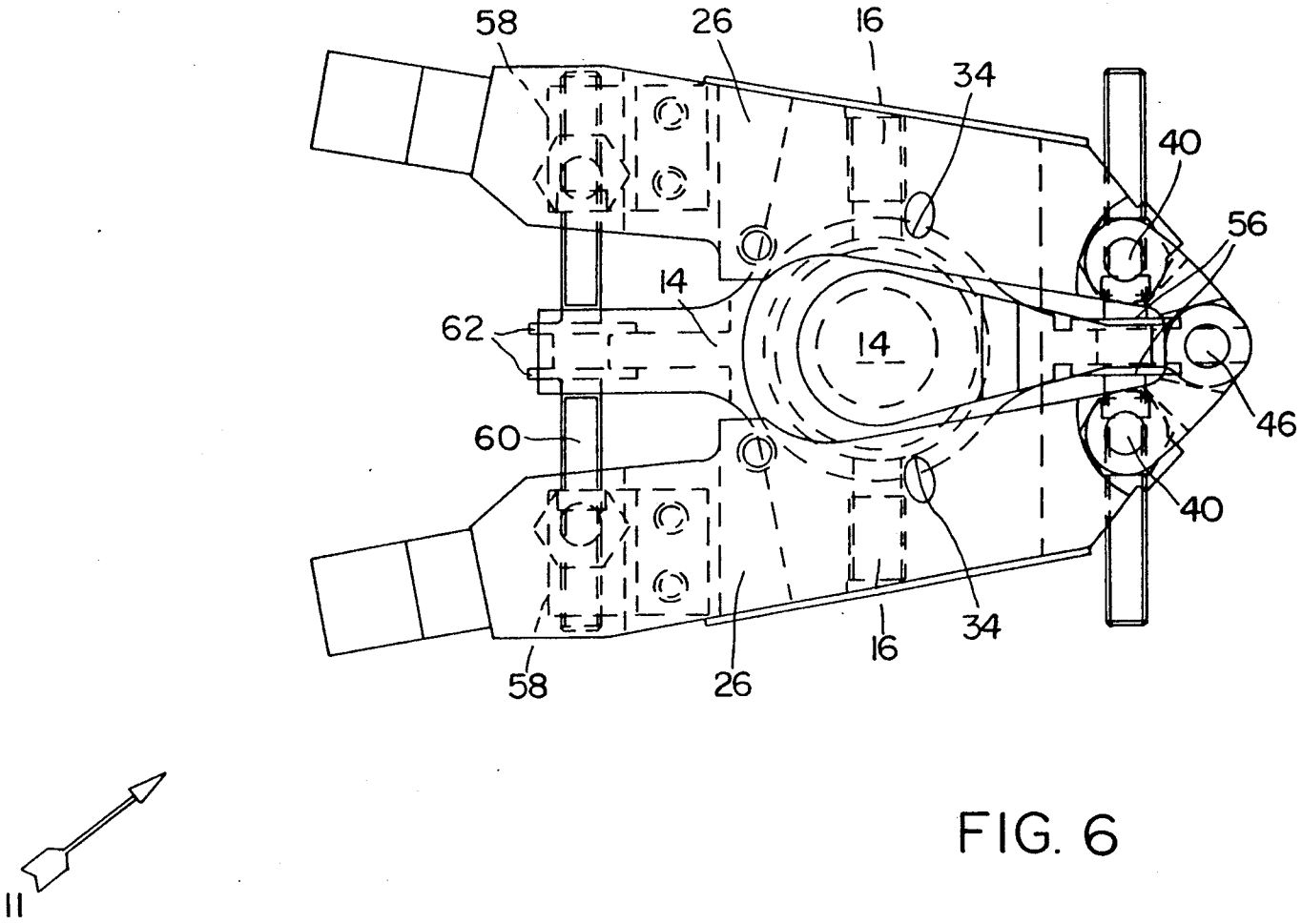

FIG. 1 is a front perspective view of a pulling over and toe lasting machine in accordance with the invention;

FIG. 2 is a top plan view, with parts broken away, showing a first wiper assembly in accordance with the invention;

FIG. 3 is an underneath plan view, with parts broken away, showing a second wiper assembly in accordance with the invention;

FIG. 4 is a perspective view of an adhesive applicator device forming part of the machine of FIG. 1;

FIG. 5 is a side view, indicating the manner in which said device is mounted in the machine; and FIG. 6 is a plan view of the device, but with elements providing an adhesive-applying surface thereof removed.

DESCRIPTION OF THE PREFERRED EMBODIMENTS

The pulling over and toe lasting machine shown in FIG. 1 and now to be described comprises a shoe support 10, which is elongated in the lengthwise direction of a shoe to be supported thereby, and an adhesive applicator device 11 which surrounds the shoe support 10, whereby adhesive can be applied to toe and forepart portions of the insole of a shoe supported by the shoe support. Arranged in an array about the applicator device 11 is a pincer assembly generally designated 114, comprising a toe pincer 116 and, at each side thereof, four side pincers 118. In addition, the machine comprises a wiper assembly generally designated 120 and a toe band 23 which engages the toe end of a shoe supported by the shoe support 10 while leaving unclamped the depending lasting marginal portions of the shoe upper in the toe and forepart region thereof. Above the shoe support 10 and to one side thereof is a toe pad 25 which is movable firstly into a position in opposed relationship with the shoe support and downwardly theretowards, the toe pad cooperating with the wiper assembly 120 to apply bedding pressure to the shoe in the course of the lasting operation. (Details of the toe pad construction and its mode of operation are to be found in UK patent specification No. 1351192.) The machine also comprises; a heel support arrangement generally designated 27 by which the heel end portion of a shoe is engaged, during the lasting cycle, in order to support the heel end of the shoe. It will thus be appreciated that the machine is generally similar, except as hereinafter described, to a conventional so-called "fixed head" pulling over and toe lasting machine.

In a first embodiment of the machine the wiper assembly 120 (FIG. 2) comprises a base plate 122 which is fixed in the machine and mounted on which, but spaced therefrom, is a cam plate 170 provided with two sets of cam slots 124 (one set being shown in full line and the position of the other set being indicated in chain-dot line in FIG. 2). In said cam slots are accommodated pins 126 mounted on a wiper carrier 128, there being thus two such wiper carriers arranged side-by-side in the wiper assembly. It will thus be appreciated that, as is conventional in pulling over and toe lasting machines, the two wiper carriers are moved forwardly (i.e. toewardly) and inwardly, by reason of the inter-action of the cam slots 124 and pins 126 in response to linear forward movement being transmitted to the wiper carriers. For effecting such linear forward movement, furthermore, there is pivotally connected to each wiper carrier a link 130, said links being in turn connected pivotally with a cross-member (not shown) which is driven by means of a piston-and-cylinder arrangement (also not shown), constituting drive means of the wiper assembly. The arrangement for effecting such forward and inward movement of the wiper carriers is also conventional.

As will be appreciated, the two wiper carriers 128 are generally mirror-opposites, and the mounting of wiper plates on the wiper carriers will now be described with reference only to the right-hand wiper carrier, as shown in FIG. 2. The wiper plate arrangement of the aforementioned wiper assembly comprises a first, toe, wiper plate 132 which is mounted on the wiper carrier 128 for pivotal adjusting movement about a pivot 134. More particularly, the wiper plate 132 is provided with an arcuate slot 136, whose centre of curvature is at the pivot 134, and there is provided on the wiper carrier a pin 138 which is accommodated in the slot 136 thus to guide the wiper plate during adjustment of its position in relation to the wiper carrier. The pin 138 also carries a clamp arrangement 140 whereby, after the position of the wiper plate has been adjusted, it can be clamped in said position. For guiding the wiper plate during its adjusting movement, furthermore, the wiper carrier is provided with an arcuate guide surface 142 which cooperates with a complementarily shaped rear surface of the wiper plate.

The wiper plate 132 thus provides a portion of the leading edge 144 of the wiper assembly 120 and a portion of the wiping surface 146 thereof. At the end of said edge portion and surface portion remote from the pivot 134, furthermore, the wiper plate 132 is formed with an integral "button" 148 and in overlapping relationship therewith is arranged a complementarily shaped button 150 formed on a second, forepart, wiper plate 152, the two buttons 148, 150, providing a pivotal connection, at the pivot 154 between the two wiper plates, 132, 152. The forepart wiper plate is held constrained, by a bifurcated extension **128*a* of the wiper carrier, for pivotal movement about the pivot 154. By virtue of the overlapping button arrangement, it will be appreciated, the wiper edge 144 and the wiping surface 146 can be maintained continuous regardless of the angular position of the wiper plate 152 in relation to the wiper plate 132**.

It will be appreciated that, when bedding pressure is applied to the wiper plates, as is conventional in pulling over and toe lasting machines, bearing in mind that, in adjusting the relative positions of the two wiper plates 132, 152 the wiper plate 152 may be moved inwards about the pivot 154, relative to the bifurcated extension **128*a*, thus leaving the major part of its surface unconstrained, an undue strain would be put on the pivot 154 during the application of such pressure. In order to counter this, therefore, a slotted support plate 172 is provided, bolted to the base plate 122, which plate receives in its slot the remote end of the wiper plate 152. For adjusting the position of the forepart wiper plate 152 relative to the wiper plate 132, the bifurcated extension 128*a* supports an adjustment screw 156 a forward end of which engages with the rear surface of the wiper plate 152** thus to set the rearward position of the plate 152 about the pivot 154. A suitable clamp arrangement 158 may again be provided; alternatively, provided that the wiper plate 152 is held against the abutment 156, e.g. by springs, when the machine is idle, it will be appreciated that contact of the wiper plate with the shoe will urge the plate into engagement with the abutment in any event.

The two toe wiper plates 132 are, as has already been mentioned, pivoted about the pivot 134. To this end, in the wiper assembly shown in FIG. 2, a separate button 160 is provided and each wiper plate 132 has an arcuately cut-away portion whereby it can "mate" with said button 160. The button 160 is carried on a slide 162 which is accommodated in a groove 164 formed in the base plate 122. The slide 162 has an upstanding lug 166 which can be engaged by a projection 168 formed on the wiper carrier 128 of the right-hand wiper plate arrangement. In this way, when forward linear movement is transmitted to the wiper carrier 128, the button 160 is moved through a commensurate distance therewith.

Instead of providing an independent button 160, it will be appreciated, in other wiper assemblies in accordance with the invention the button arrangement may be provided in a manner similar to the button arrangement 148, 150 by which the two wiper plates 132, 152 are connected, or by the button being formed integral with one of said plates and mating with a cut-away portion formed in the other.

It will of course also be appreciated that similarly the button arrangement 148, 150 may be replaced by an independent button arrangement along the lines of the button arrangement 160; in this case, no sliding movement of said button arrangement would take place, but its position in relation to the pivot 134 would be adjustable commensurately with the adjustment of the position of the toe wiper plate 132.

It will also be appreciated that, whichever button arrangement is provided in whichever of the three positions, the button arrangements should provide a smooth or substantially smooth planar surface with the adjacent portions of the wiper plates 132, 152, as the case may be. Where the wiping surface 146 of the wiper plate is chamfered, there will of course be inevitably some stepping of the button surfaces according to the angular relationships between the various wiper plates, but such stepping should be maintained at a minimum. When reference is made herein to a continuous wiping surface, it is intended that such surface may include some, relatively insignificant, stepping in the vicinity of the pivotal connections between the various plates.

In the operation of the machine incorporating the first wiper assembly described above, the configuration of the continuous surface 146, and of the wiper edge 144, is adjusted manually prior to a cycle of operation of the machine being initiated. Once this configuration has been determined, furthermore, the operation of the machine is generally as a conventional pulling over and toe lasting machine.

Whereas in the wiper assembly just described, the adjustment of the wiper plates is effected simply by releasing clamping arrangements, setting and re-clamping, which may be tedious and time-consuming, it may alternatively be desired to render such adjustment more easily carried out, e.g. by enabling the adjustment to be made from a remote position. By way of example, a suitable drive (not shown) may be provided by which the arcuate rearward surface of the toe wiper plate 132 can be engaged, e.g. a worm and rack arrangement, the drive also including a flexible drive shaft connected to a suitably disposed operator-actuatable knob; similarly, the abutment screw 156 could be connected by a flexible drive to a suitably disposed operator-actuatable knob. In such an arrangement, furthermore, the worm and rack are brought into engagement only when the wiper plate is in its rest position, thereby reducing the need for moving the whole of the adjusting mechanism during the lasting operation.

Furthermore, such an arrangement would lend itself readily to being automated. In particular, in an electronically controlled machine comprising electronic control means including a micro-processor, pattern data may be stored in a memory of the control means and control or drive signals may be supplied, in response to such pattern data, to stepping motors or other n.c. motors forming part of the drive arrangements. In such a case, the clamping arrangements would also have to be automatically operated and released.

In an arrangement as described in the last paragraph, it will be appreciated, the configuration of the continuous wiping surface 146 and its associated leading wiper edge 144 can be readily set individually to each shoe to be operated upon.

In a second wiper assembly 220 (FIG. 3) in accordance with the present invention, a top plate 222 is provided in which is formed a continuous arcuate groove 224 having a centre 234. Mounted for arcuate movement about the centre 234 are two wiper plate arrangements each comprising a wiper carrier 228, which is provided with an arcuate guide flange 226 formed complementarily with and accommodated in a portion of the groove 224.

Since the wiper arrangements are mirror-opposites, only the right hand one (viewing FIG. 3) will now be described.

Secured to the wiper carrier 228 is a first, toe, wiper plate 232 having a rearward edge which engages along a surface of the flange 226 and providing a toe part of a continuous wiping surface 246 and of a continuous leading edge 244 of the wiper assembly.

The wiper carrier 228 also is itself formed with an arcuate groove the centre of curvature of which lies at a pivot 254 about which a second, forepart, wiper plate 252 is mounted for pivotal movement. The wiper plate 252 is itself formed with an integral guide rib 276 which is arcuate and is formed complementarily to and accommodated in the groove 274. The wiper plate 252 is thus guided for arcuate movement about the pivot 254.

In the second wiper assembly 220 a central button arrangement 260 is provided having a surface portion which forms with the adjacent surface portions of the toe wiper plates 232 a continuous wiping surface. The button 260 is supported by an integral carrier which is secured to the top plate 222. In this way, the central button is fixed in relation to the top plate.

The wiper plates 232, 252 are pivotally connected to one another by a further button arrangement made up of a button portion 250 formed integral with the forepart wiper plate 252 and cooperating with a complementarily shaped cut-out 248 formed in the toe wiper plate 232.

It will of course be appreciated that in other wiper assemblies generally similar to the second wiper assembly 220, the central button may be provided by overlapping or complementarily shaped portions of the two toe wiper plates 232 inter-engaging, while similarly each button arrangement 248, 250 may be formed by the provision of an independent button arrangement mounted on the wiper carrier 228.

Each wiper plate arrangement is also provided with a base plate 278, bolted to the top plate 222 and forming a "sandwich" therewith thus to contain the wiper plates 232, 252 therebetween.

The two wiper plate arrangements and the top plate described so far are supported in a further "sandwich" comprising a base plate 270 bolted to the machine frame and a cover plate 280 secured to the base plate but spaced therefrom by spacer bars 282, the latter serving also to guide the top plate 222 for sliding movement within the space between the base and cover plates 270, 280.

In the case of the second wiper assembly it is no longer a question of adjusting the relative positions of the wiper plates about the centres 234, 254 prior to the lasting operation being initiated, but rather a question of effecting movement of the various wiper plates in an optimum manner during the lasting operation. That is to say, in this case the configuration of the continuous wiping edge 244 and continuous wiping surface 246 is varied during the lasting operation, thus to accommodate appropriately to each shoe shape. For driving the wiper plates in this manner, any suitable drive means may be provided, but this second wiper assembly is especially suitable for use in a machine provided with electronic control means, the drive means for the various wiper plates thus being constituted by drive arrangements including stepping motors or other n.c. motors. The manner in which the drive is transmitted from the stepping or like n.c. motors to the various wiper plates is again a matter of choice; for example, a worm and rack arrangement as referred to in connection with the first wiper assembly 120 may be utilised in each case. It will of course be appreciated that in this event the worm and rack are maintained constantly in engagement. Furthermore a similar drive arrangement is provided for moving the top plate 222 (which thus constitutes a carriage for the wiper plate arrangements supported thereby) linearly forwardly whereby to cause the button arrangement 260 also to wipe the lasting marginal portion of the upper over and press it against the corresponding marginal portion of the insole, such drive arrangement operating in timed relation with the drive means for the wiper plates.

It will thus be appreciated that, in using the second wiper assembly 220, not only can the wiping edge be accommodated to each size and style of shoe specifically, thereby accommodating not only rounded, pointed and square shoe toes in general, but being configurable to each variation of any one of these styles, but also, by using independent motors for each wiper plate, different configurations, and indeed different variations of configuration during the lasting cycle, may take place for left and right shoes.

In some machines, see e.g. the machine described in U.S. Pat. No. 3,579,691, the wiper plates are conventionally brought to an intermediate position in which they have just crossed the edge of the insole, thereby trapping the margin of the shoe upper against the insole. In this position an adhesive-applying operation may take place using the adhesive applicator device 11, which device is then moved out of its adhesive-applying condition to an out-of-the-way position, whereafter the wiper movement is continued. It will thus be appreciated that, in conventional pulling over and toe lasting machines, the shape of the wiper plates, and in particular the leading edge thereof, and the shape of the adhesive applicator device must be matched; otherwise there is a risk of collision therebetween when the wiper assemblies are moved to their intermediate position.

In order to avoid such collision in the machine in accordance with the present invention, the adhesive applicator device 11 is also susceptible of variation of its configuration to take account of the difference styles and sizes of shoe to be operated upon. To this end, with particular reference to FIG. 5, the adhesive applicator device comprises a block 12 which is provided with an internal recess by which the block can be accommodated at the upper end of a piston rod 14 of a piston-and-cylinder arrangement by which heightwise movement of the device 11 is effected. The block 12 is mounted for limited rocking movement on the piston rod and is held against rotation thereon by screw 16. Towards the toeward end (i.e. right-hand end, viewing FIG. 5), are provided two projecting lug portions 18 having aligned bores 20 formed therein. In addition, the block 12 provides, at each side of the piston rod 14, a supporting surface 22, to be referred to hereinafter.

The device 11 also comprises two melt chambers generally designated 24, each comprising a block 26 in which a heater element 28 is accommodated and which has an inlet 30 through which adhesive in solid rod form can be introduced into the melt chamber. By the heat supplied by heater 28, the adhesive rod is melted and flows along a passageway 32 to an outlet 34.

The forward end (i.e. right-hand end, viewing FIG. 5) of each melt chamber has two lug portions 36, again formed with aligned bores 38. In the bore formed in the upper lug portion 36 is supported a pin 40 on which is carried a further support block 42 which is generally kidney-shaped in plan view. The two support blocks 42 are formed with inter-engaging lug portions, respectively at the end thereof remote from the pin 40, and the lug portions are formed with bores 44 which can thus be aligned not only with each other but also with the bores 20 formed in the block 12. By means of a pin 46 (FIG. 6) the support blocks 42 and also, through the pins 40, the melt chambers 24 are thus all supported on the pin 46. The support surfaces 22 provided by the block 12 also serve to provide a support for the melt chambers 24.

It will be appreciated that, by virtue of the pivotal connections by means of the pins 40 and 44, the configuration of the various parts described so far can be varied. For effecting such variation, in the bore 38 formed in the lower lug portion 36 of each block 26 is accommodated a pin 48 carrying at its lower end a block 50, which is clamped against the underside of the block 26 by a clamp nut 52 accommodated between the two lug portions 36. The two blocks 50 each threadedly receives one end portion of a threaded rod 54, opposite end portions of which are provided with threads of opposite hand. Thus, by rotating the rod 54, the blocks 50 and thus the forward ends of the blocks 26 are moved towards or away from one another. For facilitating such rotation of the shaft, two rotary wheels 56 are provided centrally of the rod 54, said wheels being spaced from one another and being held against displacement in a direction lengthwise of the rod by a lug 58 formed on the underside of the forwardly projecting portion of the block 12.

It will be appreciated that, by rotating the wheels 56, the pins 40 are moved towards or away from one another so that the forward ends of the melt chambers 24 are similarly moved. Since, however, the pin 46 is fixed in the support block 12, the effect of such adjustment is to move the melt chambers also bodily in a direction lengthwise of the device.

Similar adjusting means is provided for varying the distance between the ends of the melt chambers 24 remote from the pin 46 and to this end there is mounted on the underside of the block 26 of each melt chamber a further support block 58, and a further rod 60 having opposite-handed threaded end portions is carried by the two blocks, said rod being provided with a pair of centrally disposed rotary wheels 62 spaced apart and held captive, against transverse movement, by a depending lug formed on the block 12. Whereas in the device now being described, the adjustment of these various distances is achieve manually by means of rotation of the rods 54, 60, it will be appreciated that such rotation could be motorised, e.g. by a stepping motor or other n.c. motor; alternatively instead of threaded rods as above described, wedge arrangements could be utilised.

For applying the adhesive which has been melted in the melt chambers as aforesaid, a continuous adhesive-applying surface 64 is provided by means of a plurality (in casu 4) elements 66, 68, supported by the blocks 26 and support blocks 42 as will now be described. Each element 66, which constitutes a "leg" element of the generally U-shaped configuration of the continuous surface 64, is secured by screws (not shown) to the upper surface of its associated block 26, such that an inlet passage 70 thereof coincides with the outlet 34 of the block 26. The inlet 70 is connected through internal passages formed in the element 66 to outlets 72 which open into the continuous surface 64. The elements 68 are formed with inter-engaging lug portions (see especially FIGS. 4 and 6) and bores, one of which is blind, aligned with the bores 44 of the support block 42, for receiving an upper end portion of the pin 46, and each element 68 and its adjacent element 66 are also formed with inter-engaging lug portions having bores, one (74) of which is blind, aligned with the bores 38, for receiving the upper end portion of the respective pin 40.

As will be seen most clearly from FIG. 4, adhesive is supplied to each element 68 from the melt chamber 24 associated with its associated element 66. To this end, the passage 32 formed in the block 26 has a branch 76 which is connected to a passage formed in the pin 40, which is thus tubular. The upper end of the pin 40 opens into the blind bore 74 into which also opens an internal passageway 78 formed in the element 68 and itself opening through outlet 72 into the continuous surface 64.

In this way, adhesive is supplied through all of the outlets 72 to ensure an adequate supply to the continuous surface 64.

It will thus be appreciated that using the variable-configuration adhesive applicator device 11 in conjunction with either one of the wiper assemblies 120, 220 in accordance with the present invention, a fully adjustable system is provided which enables the need for so-called "bespoke" fittings, conventional in currently available pulling over and toe lasting machines, to be dispensed with. Moreover, especially in the case of the second wiper assembly, the configuration of the continuous wiping surface 246 and leading edge 244 of the wiper assembly can be "tailored" specifically to the requirements made by the shoe shape not only as a general compromise at the start of the lasting operation, but actually during the lasting cycle.

We claim:

1. Wiper assembly for a shoe lasting machine comprising two wiper plate arrangements providing a continuous wiping surface and leading edge and being mounted for pivotal movement relative to one another about a centrally disposed pivot, wherein said wiper plate arrangement comprises a first, toe wiper plate mounted for pivotal movement about said centrally disposed pivot, a second, forepart, wiper plate which is mounted for pivotal adjusting movement about a second pivot in relation to the toe wiper plate thus to vary the configuration of the continuous wiping surface and leading edge formed by the two wiper plates, and means whereby the forepart wiper plate is maintained in adjusted position in relation to the toe wiper plate, when the assembly is in use, during inwiping movement of the wiper plate arrangements to cause lasting marginal portions of the upper of a shoe to be wiped over and pressed against corresponding marginal portions of the insole of such shoe.

2. Wiper assembly according to claim 1 wherein each wiper plate arrangement is supported by a base plate and comprises a wiper carrier by which pivotal movement as aforesaid and also linear movement relative to said base plate is transmitted to the toe wiper plate and to the forepart plate maintained in adjusted position in relation thereto as aforesaid and wherein the toe wiper plate is mounted for pivotal adjusting movement relative to the wiper carrier about the centrally disposed pivot, means being provided for locking the toe wiper plate in adjusted position.

3. Wiper assembly according to claim 2 wherein the forepart wiper plate is pivotally connected to the toe wiper plate whereby adjustment of the position of the latter as aforesaid also adjusts the position of the former in relation to the carrier, and further the position of the forepart wiper plate relative to the toe wiper plate and to the carrier is independently adjustable.

4. Wiper assembly according to claim 3 wherein means is provided for locking the forepart wiper plate in adjusted position.

5. Wiper assembly according to claim 2 wherein means is provided on the wiper carrier for adjusting the position of the forepart wiper plate thereon, in which position said plate is maintained as aforesaid during the inwiping movement of the wiper plate arrangement.

6. Wiper assembly for a shoe lasting machine comprising two wiper plate arrangements providing a continuous wiping surface and leading edge and being mounted for pivotal movement relative to one another about a centrally disposed pivot, wherein each wiper plate arrangement comprises a wiper carrier mounted for pivotal movement about the centrally disposed pivot, a first, toe, wiper plate mounted on the wiper carrier for pivotal adjusting movement relative thereto about said centrally disposed pivot, means for locking the toe wiper plate in adjusted position on the wiper carrier, a second, forepart, wiper plate which is mounted for pivotal adjusting movement in relation to its associated toe wiper plate about a second pivot disposed therebetween and also to the wiper carrier, and means on the wiper carrier for setting the position of the forepart wiper plate in relation thereto and to the toe wiper plate, in which position the forepart wiper is maintained, when the assembly is in use, during inwiping movement of the wiper plate arrangements to cause lasting marginal portions of the upper of a shoe to be wiped over and pressed against corresponding marginal portions of the insole of such shoe.

7. Wiper assembly according to claim 6 wherein means is provided for locking the forepart wiper plate in adjusted position.

8. Wiper assembly for a shoe lasting machine comprising two wiper plate arrangements providing a continuous wiping surface and leading edge and being mounted for movement relative to a shoe supported by a shoe support both pivotally relative to one another about a centrally disposed pivot and also bodily in a direction extending lengthwise of the shoe bottom thus to effect an inwiping movement whereby lasting marginal portions of the upper of such shoe are wiped over and pressed against corresponding marginal portions of an insole, and drive means for affecting such movement of the wiper plate arrangements, wherein each wiper plate arrangement comprises a first, toe, wiper plate, the two toe wiper plates being mounted for pivotal movement about said centrally disposed pivot, and further comprises a second "forepart", wiper plate which is mounted for pivotal adjusting movement in relation to its associated toe wiper plate about a second pivot disposed therebetween, thus to vary the configuration of the wiping surface and leading edge of the arrangement comprising the two wiper plates, said two wiper plates are being maintained in adjusted position in relation to one another, and thus said configuration being maintained, as the lasting marginal portions of the shoe upper are wiped over and pressed against corresponding marginal portions of the insole thereby as aforesaid.

9. Wiper assembly according to claim 8 wherein the centrally disposed pivot is constituted by a button formed independently of either wiper plate arrangement and mounted for sliding movement lengthwise of the shoe in response to bodily movement of said arrangements as aforesaid.

10. Wiper assembly according to claim 8 wherein each wiper plate arrangement comprises a wiper carrier by which linear and inwiping movement is transmitted to the wiper plates, and the toe wiper plate is mounted for pivotal movement relative to the carrier about the centrally disposed pivot, whereby the position of said plate can be adjusted relative to the carrier.

11. Wiper assembly according to claim 10 wherein the forepart wiper plate is pivotally connected to the toe wiper plate whereby adjustment of the position of the latter as aforesaid also adjusts the position of the former in relation to the carrier, and further the position of the forepart wiper plate relative to the toe wiper plate and to the carrier is independently adjustable.

12. Wiper assembly according to claim 11 further comprising first adjustment means for adjusting the position of the toe wiper plate as aforesaid, together with first locking means for locking the plate in its adjusted position, and second adjustment means for independently adjusting the position of the forepart wiper plate as aforesaid, together with second locking means for locking said plate in its adjusted position.

13. Wiper assembly according to claim 12 wherein the first adjustment means is arranged to be operatively connected with the toe wiper plate when the wiper plate arrangements are in a rest position, the arrangement being such that prior to lengthwise movement of said arrangements being effected as aforesaid, whereby such operative connection is disconnected, the first clamping means is rendered operative.

14. Wiper assembly according to claim 12 wherein the second adjustment means is arranged to be operatively connected with the forepart wiper plate when the wiper plate arrangements are in a rest position, the arrangement being such that prior to lengthwise movement of said arrangements being effected as aforesaid, whereby such operative connection is disconnected, the second clamping means is rendered operative.

15. Wiper assembly according to claim 14 wherein the centrally disposed pivot is constituted by a button formed independently of either wiper plate arrangement and mounted for sliding movement lengthwise of the shoe in response to bodily movement of said arrangements as aforesaid.

16. Wiper assembly according to claim 8 wherein the wiper plate arrangements are mounted in a support by which a cam track arrangement is supported, the arrangement being such that as lengthwise bodily movement of the wiper plate arrangements is effected as aforesaid, the cam track arrangement is effective to cause pivoting, inwiping, movement thereof to take place.

17. Wiper assembly according to claim 16 wherein each wiper plate arrangement comprises a wiper carrier by which linear and inwiping movement is transmitted to the wiper plates, and the toe wiper plate is mounted for pivotal movement relative to the carrier about the centrally disposed pivot, whereby the position of said plate can be adjusted relative to the carrier.

18. Wiper assembly according to claim 17 wherein the forepart wiper plate is pivotally connected to the toe wiper plate whereby adjustment of the position of the latter as aforesaid also adjusts the position of the former in relation to the carrier, and further the position of the forepart wiper plate relative to the toe wiper plate and to the carrier is independently adjustable.

19. Wiper assembly according to claim 18 further comprising first adjustment means for adjusting the position of the toe wiper plate as aforesaid, together with first locking means for locking the plate in its adjusted position, and second adjustment means for independently adjusting the position of the forepart wiper plate as aforesaid, together with second locking means for locking said plate in its adjusted position.

20. Wiper assembly according to claim 19 wherein the first adjustment means is arranged to be operatively connected with the toe wiper plate when the wiper plate arrangements are in a rest position, the arrangement being such that prior to lengthwise movement of said arrangements being effected as aforesaid, whereby such operative connection is disconnected, the first clamping means is rendered operative.

21. Wiper assembly according to claim 20 wherein the second adjustment means is arranged to be operatively connected with the forepart wiper plate when the wiper plate arrangements are in a rest position, the arrangement being such that prior to lengthwise movement of said arrangements being effected as aforesaid, whereby such operative connection is disconnected, the second clamping means is rendered operative.

22. Wiper assembly according to claim 18 wherein the wiper plate arrangements are mounted in a carriage which is moved by the drive means in a direction lengthwise of the shoe, and the centrally disposed pivot is constituted by a button formed independently of either wiper arrangement and fixedly mounted on said carriage.

23. Wiper assembly for a shoe lasting machine comprising two wiper plate arrangements providing a continuous wiping surface and leading edge and being mounted for movement relative to a shoe supported by a shoe support both pivotally relative to one another about a centrally disposed pivot and also bodily in a direction extending lengthwise of the shoe bottom thus to effect an inwiping movement whereby lasting marginal portions of the upper of such shoe are wiped over and pressed against corresponding marginal portions of an insole, and drive means for effecting such movement of the wiper plate arrangements, wherein each wiper plate arrangement comprises a wiper carrier which is mounted for movement under the action of the drive means both pivotally about said centrally disposed pivot and also linearly, bodily with the wiper carrier of the other wiper plate arrangement, a first, toe, wiper plate mounted on the wiper carrier for pivotal adjusting movement relative thereto about said centrally disposed pivot, means for locking the toe wiper plate in adjusted position on the wiper carrier, a second, forepart, wiper plate which is mounted for pivotal adjusting movement in relation to its associated toe wiper plate about a second pivot disposed therebetween to the wiper carrier, such adjustment of the positions of the two wiper plates serving to vary the configuration of the wiping surface and leading edge of the wiper plate arrangement, and means on the wiper carrier for setting the position of the forepart wiper plate in relation thereto and to the toe wiper plate, in which position the forepart wiper plate is maintained as the lasting marginal portions of the shoe upper are wiped over and pressed against corresponding marginal portions of the insole thereby as aforesaid.

24. Wiper assembly according to claim 23 wherein locking means is provided for locking the forepart wiper plate in adjusted position on the wiper carrier.

25. Wiper assembly according to claim 23 wherein the centrally disposed pivot is constituted by a button formed independently of either wiper plate arrangement and mounted for sliding movement lengthwise of the shoe in response to bodily movement of said arrangements as aforesaid.

26. Wiper assembly according to claim 23 wherein the wiper carriers are mounted in a support by which a cam track arrangement is supported, such that as linear bodily movement of the wiper carriers is effected as aforesaid the cam track arrangement is effective to cause pivotal movement thereof to take place as aforesaid.

27. Wiper assembly for a shoe lasting machine comprising two wiper plate arrangements providing a continuous wiping surface and leading edge and being mounted for movement relative to a shoe supported by a shoe support both pivotally relative to one another about a centrally disposed pivot and also bodily in a direction extending lengthwise of the shoe bottom thus to effect an inwiping movement whereby lasting marginal portions of the upper of such shoe are wiped over and pressed against corresponding marginal portions of an insole, wherein each wiper plate arrangement comprises a wiper carrier which is mounted for pivotal movement about said centrally disposed pivot and is movable linearly, bodily with the wiper carrier of the other wiper plate arrangement, together with said centrally disposed pivot, a first, toe, wiper plate fixedly mounted on the wiper carrier for pivotal movement therewith about said centrally disposed pivot, a second, forepart, wiper plate which is mounted on the wiper carrier for pivotal movement, about a second pivot disposed between the first and second wiper plates, relative to the wiper carrier and also to the first wiper plate while maintaining the continuous wiping surface and leading edge, first drive means for effecting pivotal movement of the wiper carrier and thus of the first and second wiper plates mounted as aforesaid thereon, and second means, operable independently of the first drive means, for effecting pivotal movement of the second wiper plate relative thereto and to the first wiper plate.

28. Wiper assembly according to claim 22 wherein each wiper carrier and the forepart wiper plate have arcuate guide means, comprising an arcuate cam track and arcuate guide rib accommodated therein, the centre of curvature of said track and guide rib being coincident with the second pivot.

29. Wiper assembly according to claim 27 wherein the wiper plate arrangements are mounted in a carriage which is mounted for movement in a direction extending lengthwise of the shoe, further drive means being provided for effecting such movement.

30. Wiper assembly according to claim 29 wherein the centrally disposed pivot is constituted by a button formed independently of either wiper arrangement and fixedly mounted on said carriage.

31. Wiper assembly according to claim 29 wherein the carriage and the two wiper carriers have arcuate guide means comprising arcuate cam track portions and arcuate guide ribs accommodated therein, the centre of curvature of said track portions and guide ribs being coincident with the centrally disposed pivot.

32. Wiper assembly according to claim 29 wherein the first and second drive means of each wiper plate arrangement and also the further drive means for the carriage each comprises a numerically controlled motor.

33. Wiper assembly according to claim 27 wherein the wiper plate arrangements are mounted in a carriage which is moved by further drive means in a direction lengthwise of the shoe, and which comprises two arcuate cam track portions each having a centre of curvature coincident with the centrally disposed pivot, and one associated with each wiper plate arrangement for guiding the wiper carrier thereof, each wiper carrier having an arcuate cam track portion, of which the centre of curvature is coincident with the second pivot, for guiding the forepart wiper plate associated therewith.

34. Wiper assembly according to claim 27 wherein the centrally disposed pivot is constituted by a button formed independently of either wiper arrangement and fixedly mounted on said carriage.

35. Shoe lasting machine comprising a shoe support for supporting a shoe, comprising a shoe upper on a last and an insole on the last bottom, a pincer assembly comprising a plurality of pincers arranged in a generally U-shaped array about the shoe support, whereby lasting marginal portions of a shoe upper can be gripped and, by relative movement being effected between the shoe support and pincer assembly, the upper can be tensioned about its last, an adhesive applicator device for applying adhesive to marginal portions of the insole of a shoe after the upper thereof has been tensioned as aforesaid, said device comprising a plurality of elements arranged in a generally U-shaped configuration and providing a continuous surface to which adhesive is supplied and which can be pressed into contact with the marginal portions of the insole, and a wiper assembly comprising two wiper plate arrangements providing a continuous wiping surface and leading edge and being mounted for pivotal movement relative to one another about a centrally disposed pivot, wherein the configuration of the continuous surface provided by the applicator device can be varied by varying the relationship between said elements, and wherein the elements of said device comprise two "base" elements, pivotally connected to one another, forming the base of the U, and two "leg" elements, one pivotally connected to each of the "base" elements, forming the "legs" of the U, and means is provided for adjusting the configuration of said surface by adjusting the distance between the pivotal connections of the "leg" elements with the "base" elements and also the distance between the remote ends of the "leg" elements, and further wherein each wiper plate arrangement of the wiper assembly comprises a first, toe, wiper plate mounted for pivotal movement about said centrally disposed pivot, a second, forepart, wiper plate which is mounted for pivotal adjusting movement about a second pivot in relation to the toe wiper plate thus to vary the configuration of the continuous wiping surface and leading edge formed by the two wiper plates, and means whereby the forepart wiper plate is maintained in adjusted position in relation to the toe wiper plate, when the assembly is in use, during inwiping movement of the wiper plate arrangements to cause lasting marginal portions of the upper of a shoe to be wiped over and pressed against corresponding marginal portions of the insole of such shoe. wherein the adhesive applicator device comprises at least two "base" elements, forming the base of the U, and at least two "leg" elements, forming the sides of the U, said elements each providing a portion of the continuous surface of the device and being pivotally connected together, and the configuration of said surface being variable by varying the relationship between the elements, and wherein each wiper plate arrangement comprises a plurality of wiper plates mounted for pivotal movement in relation to one another so as to enable the configuration of the portion of the continuation wiping surface provided by each of the wiper plate arrangements to be varied.

36. Shoe lasting machine comprising a shoe support for supporting a shoe, comprising a shoe upper on a last and an insole on the last bottom, a pincer assembly comprising a plurality of pincers arranged in a generally U-shaped array about the shoe support, whereby lasting marginal portions of a shoe upper can be gripped and, by relative movement being effected between the shoe support and pincer assembly, the upper can be tensioned about its last, an adhesive applicator device for applying adhesive to marginal portions of the insole of a shoe after the upper thereof has been tensioned as aforesaid, said device comprising a plurality of elements arranged in a generally U-shaped configuration and providing a continuous surface to which adhesive is supplied and which can be pressed into contact with the marginal portions of the insole, and a wiper assembly comprising two wiper plate arrangements providing a continuous wiping surface and leading edge and being mounted for pivotal movement relative to one another about a centrally disposed pivot, wherein the configuration of the continuous surface provided by the applicator device can be varied by varying the relationship between said elements, and wherein said wiper plate arrangement comprises a wiper carrier mounted for pivotal movement about the centrally disposed pivot, a first, toe, wiper plate mounted on the wiper carrier for pivotal adjusting movement relative thereto about said centrally disposed pivot, means for locking the toe wiper plate in adjusted position on the wiper carrier, a second, forepart, wiper plate which is mounted for pivotal adjusting movement in relation to its associated toe wiper plate about a second pivot disposed therebetween and also to the wiper carrier, and means on the wiper carrier for setting the position of the forepart wiper plate in relation thereto and to the toe wiper plate, in which position the forepart wiper is maintained, when the assembly is in use, during inwiping movement of the wiper plate arrangements to cause lasting marginal portions of the upper of a shoe to be wiped over and pressed against corresponding marginal portions of the insole of such shoe.

37. Shoe lasting machine comprising a shoe support for supporting a shoe, comprising a shoe upper on a last and an insole on the last bottom, a pincer assembly comprising a plurality of pincers arranged in a generally U-shaped array about the shoe support, whereby lasting marginal portions of a shoe upper can be gripped and, by relative movement being effected between the shoe support and pincer assembly, the upper can be tensioned about its last, an adhesive applicator device for applying adhesive to marginal portions of the insole of a shoe after the upper thereof has been tensioned as aforesaid, said device comprising a plurality of elements arranged in a generally U-shaped configuration and providing a continuous surface to which adhesive is supplied and which can be pressed into contact with the marginal portions of the insole, and a wiper assembly comprising two wiper plate arrangements providing a continuous wiping surface and leading edge and being mounted for pivotal movement relative to one another about a centrally disposed pivot, wherein each wiper plate arrangement comprises a wiper carrier which is mounted for pivotal movement about said centrally disposed pivot and is movable linearly, bodily with the wiper carrier of the other wiper plate arrangement, together with said centrally disposed pivot, a first, toe, wiper plate fixedly mounted on the wiper carrier for pivotal movement therewith about said centrally disposed pivot, a second, forepart, wiper plate which is mounted on the wiper carrier for pivotal movement, about a second pivot disposed between the first and second wiper plates, relative to the wiper carrier and also to the first wiper plate while maintaining the continuous wiping surface and leading edge, first drive means for effecting pivotal movement of the wiper carrier and thus of the first and second wiper plates mounted as aforesaid thereon, and second drive means, operable independently of the first drive means, for effecting pivotal movement of the second wiper plate relative thereto and to the first wiper plate.

* * * * *